US007181309B2

(12) United States Patent
Kazuyoshi

(10) Patent No.: US 7,181,309 B2
(45) Date of Patent: Feb. 20, 2007

(54) METHOD OF KNITTING GARMENTS HAVING LINE DIFFERENCE, GARMENT HAVING LINE DIFFERENCE, AND KNIT DESIGN DEVICE

(75) Inventor: Okamoto Kazuyoshi, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 0 days.

(21) Appl. No.: 10/560,534

(22) PCT Filed: Jun. 10, 2004

(86) PCT No.: PCT/JP2004/008124

§ 371 (c)(1),
(2), (4) Date: Dec. 13, 2005

(87) PCT Pub. No.: WO2005/001184

PCT Pub. Date: Jan. 6, 2005

(65) Prior Publication Data

US 2006/0137406 A1 Jun. 29, 2006

(30) Foreign Application Priority Data

Jun. 30, 2003 (JP) ..... 2003-187094

(51) Int. Cl.
*G06F 19/00* (2006.01)
*D04B 7/30* (2006.01)

(52) U.S. Cl. ..... 700/141; 66/64; 66/176

(58) Field of Classification Search ..... 66/64, 66/69, 170–176, 60 R, 189, 75.1; 700/130, 700/141
See application file for complete search history.

(56) References Cited

U.S. PATENT DOCUMENTS 5,987,930 A * 11/1999 Nakai ..... 66/69
6,286,340 B1 * 9/2001 Yui ..... 66/70
6,581,417 B2 * 6/2003 Yui ..... 66/176
6,655,175 B1 * 12/2003 Okamoto ..... 66/69
6,658,899 B2 * 12/2003 Okamoto ..... 66/64
6,748,770 B2 * 6/2004 Okamoto ..... 66/64
6,889,530 B2 * 5/2005 Urano et al. ..... 66/64

* cited by examiner

*Primary Examiner*—Danny Worrell
(74) *Attorney, Agent, or Firm*—Rothwell, Figg, Ernst & Manbeck

(57) ABSTRACT

A body and both sleeves are knitted into cylindrical shapes, respectively, up to the underarm positions. Then, sleeve caps for both sleeves are knitted by flechage knitting such that the front sleeve caps become narrower than the back sleeve caps. Both sleeves are connected to the body using gores. The gores between the front body and both front sleeves are larger than the gores between the back body and both back sleeves. Then, the front body and the back body are knitted such that the knitting width of the front body becomes smaller than the knitting width of the back body. The front body and the back body are joined to both sleeves, and upper ends of the front body and the back body are joined together.

6 Claims, 8 Drawing Sheets

METHOD OF KNITTING GARMENTS HAVING LINE DIFFERENCE, GARMENT HAVING LINE DIFFERENCE, AND KNIT DESIGN DEVICE

CROSS REFERENCE TO RELATED APPLICATION

This application is a 35 USC § 371 Phase Entry Application from PCT/JP2004/008124, filed Jun. 10, 2004, and designating the United States.

TECHNICAL FIELD

The present invention relates to knitting of a garment such as a sweater, a vest, a one-piece suit, and a dress. In particular, the present invention relates to knitting of a garment with asymmetrically joined front and back sleeves and asymmetrically joined front and back bodies. The sleeves are oriented forward such that the garment fits the body shape of human. Further, the present invention relates to a knitting method for such a garment with asymmetrically joined sleeves, the garment with asymmetrically joined sleeves produced by knitting, and a knit design device for generating the required knitting data.

BACKGROUND ART

The applicant contrived a technique of knitting by a flat knitting machine to produce a cylindrical knitted fabric without sewing, and successively putted the technique into practical use. Japanese Patent Publication No. 3-75656 proposes a knitting method for knitting a cylindrical rib using a flat knitting machine having two beds. The method is known as broad rib knitting. In the method, every other needle in the front and back needle beds is used. Japanese Laid-Open Patent Publication No. 8-158209 proposes a method of joining two knitted fabrics. For example, five knit stitches of one fabric are joined to five knit stitches of the other knitted fabric. In this case, the knitted fabrics are joined together such that knit stitches at the center of one knitted fabric are overlapped with knit stitches at the center of the other knitted fabric, or knit stitches at both ends of one knitted fabric are overlapped with knitted stitches at both ends of the other knitted fabric.

Japanese Laid-Open Patent Publication No. 9-310254, Japanese Laid-Open Patent Publication No. 10-226947, and Japanese Laid-Open Patent Publication No. 10-77556 propose methods for joining knitted fabrics or cast off stitches. Japanese Laid-Open Patent Publication No. 2000-256947 discloses flechage knitting of a sleeve cap. WO00/12799 discloses a knitting method for permitting the entry of an upper end of a front body into a back body beyond a shoulder line. WO01/55491 discloses a method of knitting a neckline. WO01/88243 discloses a method of knitting a gore between a sleeve and a body. WO01/94671 discloses a method of joining a T-sleeve and a body.

In the textile product, it is a common practice that asymmetrically joined front and back sleeves are provided for fitting the body shape of human. However, as the knit product without sewing, no sweater with asymmetrically joined front and back sleeves has been produced so far. If the front sleeve and the back sleeve are asymmetrically joined such that the sleeves are oriented forward, the garment (sweater) can be worn as the comfortable cloth. However, no method for knitting such a sweater is known.

SUMMARY OF THE INVENTION

An object of the present invention is to provide a method of knitting a garment with asymmetrically joined front and back sleeves substantially without sewing in which when the garment is worn, the sleeves are oriented forward, and fits the human body, to provide such a garment, and to provide a knit design device for generating the required knitting program.

According to a method of knitting a garment with asymmetrically joined sleeves, a body and both sleeves are knitted up to underarm positions to have cylindrical shapes, respectively, then, both sleeves to the body are joined, and then, upper ends of a front body and a back body of the body are joined. The method comprises the steps of:

(a) after knitting both sleeves to the underarm positions, knitting sleeve caps comprising front sleeve caps and back sleeve caps for both sleeves by flechage knitting such that the front sleeve caps become narrower than the back sleeve caps;

(b) then, forming gores at the underarm positions for connecting both front sleeves and the front body without forming any gores between both back sleeves and the back body, or in the case of forming gores between both back sleeves and the back body, forming gores at the underarm positions for connecting both front sleeves and the front body such that the gores between both back sleeves and the back body become smaller than the gores between both front sleeves and the front body; and (c) then, knitting the front body and the back body and joining the front body and the back body to both sleeves such that the knitting width of the front body becomes smaller than the knitting width of the back body above the underarm positions.

In the specification, "without sewing" means the knitting method in which sewing is not carried out at all, or the knitting method in which no knitting is carried out at the time of forming the gores, and joining the sleeves and the body. The upper/lower, left/right, and back/front sides of the garment are determined based on the state in which the garment is worn on the body. Knitting is started from the lower side. The neck hole and collar are on the upper side. The front side or the backside, and the racking (swaying) direction are determined based on the state as viewed from the front side toward the knitting machine. The front side may be simply referred to as the "front", and the backside may be simply referred to as the "back". Left swaying as viewed from the front side is referred to as "racking to the left", and right swaying as viewed from the front side is referred to as "racking to the right".

It is preferable that the knitting method further comprises the step of, after the step (c), knitting the front body separately into a left front body and a right front body at a neck hole portion, and expanding the left front body toward the left sleeve side, expanding the right front body toward the right sleeve side such that a left upper end of the left front body is substantially aligned with a left upper end of the back body in the left-right direction and a right upper end of the right front body is substantially aligned with a right upper end of the back body in the left-right direction.

Further, it is preferable that the step (c) is carried out in a state in which one ends of the front body and the back body face each other on a needle bed, and the other ends of the front body and the back body do not face each other on the needle bed.

In particular, it is preferable that the step (c) comprises the steps of:

overlapping a knit stitch at the one end of the front body with an adjacent knit stitch of the sleeve, and overlapping a knit stitch at the other end of the back body with an adjacent knit stitch of the sleeve;

overlapping a knit stitch at the other end of the front body with an adjacent knit stitch of the sleeve; and overlapping a knit stitch at the one end of the back body with an adjacent knit stitch of the sleeve; and knitting a course of new knit stitches on the front body and the back body.

Further, a garment according to the present invention includes a body comprising a cylindrical knitted fabric and both sleeves each comprising a cylindrical knitted fabric. The body and both sleeves are joined on sides by knitting operation without sewing, and a front body and a back body of the body are joined at shoulders, and (a) both sleeves include front and back sleeve caps above underarm positions, and the front sleeve caps are narrower than the back sleeve caps;

(b) front portions of both sleeves are joined to the front body at the underarm positions by gores such that the knitting width of the front body becomes smaller than the knitting width of the back body above the underarm positions; and (c) the front body and the back body are joined to both sleeves without sewing on sides.

A knit design device according to the present invention is capable of generating knitting data for knitting a garment by knitting a body and both sleeves up to underarm positions to have cylindrical shapes, respectively, then, joining both sleeves to the body, and then, joining upper ends of a front body and a back body of the body. The knitting data comprises:

(a) knitting data of sleeve caps for knitting in a manner that after knitting both sleeves up to underarm positions, sleeve caps comprising front sleeve caps and back sleeve caps for both sleeves are knitted by flechage knitting such that the front sleeve caps become narrower than the back sleeve caps;

(b) knitting data of gores for knitting in a manner that gores at the underarm positions for connecting both front sleeves and the front body are formed without forming any gores between both back sleeves and the back body, or in the case of forming gores between both back sleeves and the back body, gores are formed at the underarm positions for connecting both front sleeves and the front body such that the gores between both back sleeves and the back body become smaller than the gores between both front sleeves and the front body; and (c) knitting and joining data of the body and the sleeves, for knitting the front body and the back body and joining the front body and the back body to both sleeves such that the knitting width of the front body becomes smaller than the knitting width of the back body above the underarm positions, wherein the pieces of knitting data are used by a flat knitting machine in the order of (a) to (c).

In the present invention, sleeve caps of both sleeves are knitted by flechage knitting such that the front sleeve caps become narrower than the back sleeve caps. Then, the sleeves and the body are connected such that the gores connecting the front sleeves and the front body become larger than the gores connecting the back sleeves and back body, or no gore is formed between the back sleeves and the back body. Assuming that the knitting width of the front body and the knitting width of the back body are the same up to the underarm positions, since the gores are only present on the front body side, or since the length of the gores on the front side is different from the length of the gores on the backside, the knitting width of the front body becomes smaller than the knitting width of the back body from the gores (above the gores). Further, the sleeve caps of the front sleeves are narrower than the sleeve caps of the back sleeves. Thus, for example, the borders between the front sleeves and the back sleeves are shifted to the front sleeve side. Therefore, the sleeves are oriented to the front side, and the garment has a silhouette which fits the body shape of human.

It is preferable that the front body is knitted separately into the left side and the right side at he portion of the neck hole such that the left front body and the right front body are expanded to the sleeve sides, respectively. As a result, the portion corresponding to the reduction in the knitting width of the front body is compensated by the gores. Both of the left and right ends of the front body and both of the left and right ends of the back body appear substantially at the same positions. Thus, joining at the shoulders can be carried out easily.

At the time of knitting and joining the sleeves and the front body or the back body, if one end of the front body and one end of the back body are aligned to face each other on the needle bed, the yarn feed portion for the front body having the narrow knitting width can be positioned outside the knitting width of the back body. Therefore, the yam feed portion of the front body does not obstruct the knitting operation.

In order to join the sleeves to the body, when the knit stitches of the sleeves are overlapped with the knit stitches of the body by transferring, in the finished garment, the knit stitches twisted by transferring appear on the backside of the knit stitches of the body. Therefore, the twist of the knit stitches cannot be seen easily. Further, if one end of front body and one end of the back body are aligned with each other, the knit stitches at the end of the sleeves can be overlapped with one end of the front body and the other end of the back body by transferring, e.g., at the same time, or in the adjacent steps. If the step of overlapping the knit stitches of the sleeve with the other end of the front body and the step of overlapping the knit stitches of the sleeve with one end of the back body are carried out separately, in particular, if these steps are carried out separately, it is possible to form overlapped stitches at both ends of the front body and the back body. Then, the front body and the back body are knitted such that new knit stitches are formed on these overlapped stitches. In this manner, knitting of the front body and the back body, and joining of the front body and the back body to the sleeves can be carried out easily.

In the garment with asymmetrically joined sleeves according to the present invention, both sleeves are oriented forward naturally, and the garment fits the human body when it is worn. Further, when the garment with asymmetrically joined sleeves according to the present invention is worn, wrinkles are few on the front side, and the stress is small on the backside. Thus, a beautiful silhouette can be obtained. In the knit design device according to the present invention, knitting data of the garment with asymmetrically joined sleeves can be generated.

Embodiments

Figure 1:
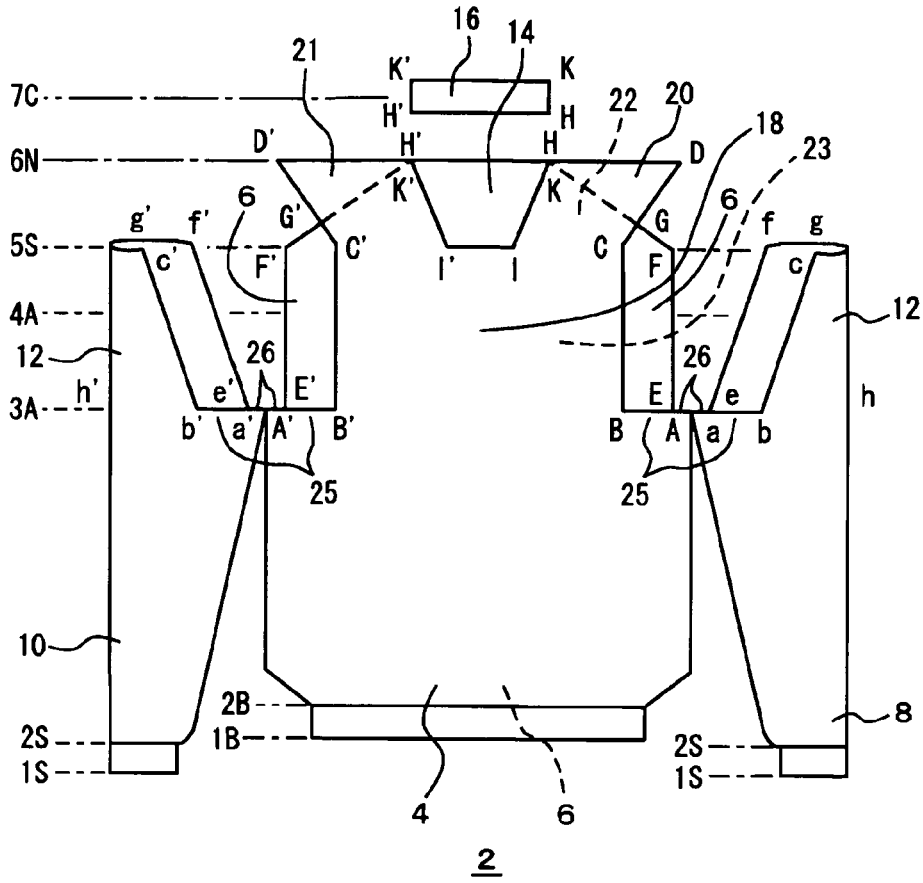
FIG. 1 is a view showing a pattern of a sweater with asymmetrically joined sleeves knitted in an embodiment.

Hereinafter, embodiments in the most preferred form for carrying out the present invention will be described.

An embodiment and its modified embodiment will be described with reference to FIGS. 1 to 12. FIGS. 1 to 4 shows a design of a sweater 2 knitted in the embodiment. A reference numeral 4 denotes a front body. A back body 6 is present on the backside of the front body 4, and a left sleeve 8 and a right sleeve 10 are present on the left and right sides of the front body 4. The left and right sides are determined based on the state in which the sweater 2 is worn. Therefore, the left and the right sides in the drawings appear oppositely to the normal left and right sides. In the drawings, lowercase letters denote positions on the sleeve side, and uppercase letters denote positions on the body side. The points denoted by corresponding alphabets, e.g., the lowercase letter "a" and the uppercase letter "A" are overlapped with each other at the same position by knitting. It should be noted that points D, D' at the upper end of the front body 4, and points F, F' at the upper end of the back body 6 are at the same positions, respectively. In FIGS. 1 to 4, for illustration purpose, the armhole lines (joint portions between the sleeves and the body) are straight. Alternatively, the armhole lines may be curved.

(A, a), (A', a') denote underarm positions. Knitting of the front body 4 and the back body 6 is started from a portion of the bottom rubber 1B to 2B. The front body 4 and the back body 6 are knitted to have a cylindrical shape until a knitting state 3A, i.e., until the front body 4 and the back body 6 have been knitted up to the underarm positions. Likewise, knitting of the left sleeve 8 and the right sleeve 10 is started from portions of the bottom rubber 1S to 2S. The left sleeve 8 and the right sleeve 10 are knitted to have cylindrical shapes, respectively. At the underarms positions, knitting of the front body 4 and the back body 6 is temporarily interrupted, and sleeve caps 12 are knitted for both of the left and right sleeves 8 and 10. The sleeve caps 12 are knitted by flechage knitting. Needles for points (e~a~b) are not operated for the cylindrical left sleeve 8, and the remaining sleeve needles are operated for knitting the sleeve cap. The knitting width (knitting width is determined by the needles operated for knitting) of the sleeve cap is reduced gradually to the range of (f~g~c). At this time, the respective knit stitches of the left sleeve 8 remain hooked by the needles. The sleeve cap 12 is wide on the back sleeve side, and the sleeve cap 12 is narrow on the front sleeve side. Stated otherwise, the armhole is large on the front side, and small on the backside. In the same manner, the sleeve cap 12 for the right sleeve 10 is knitted by flechage knitting. The sleeve cap 12 on the front sleeve side is narrower than the sleeve cap 12 on the back sleeve side.

A reference numeral 14 denotes a neck hole. A reference numeral 16 denotes a collar around the neck hole 14, and the collar 16 may not be provided. A reference numeral 18 denotes an upper front body extending from the underarm positions to the position below the neck hole 14. An upper back body 23 is present on the backside of the upper front body 18. The upper front body 18 and the upper back body 23 are knitted from the knitting state 3A to the knitting state 5S after the knitting state 4A as shown in FIG. 1. In the portion (5S to 6N) of the neck hole 14, the front body is knitted separately into a left front shoulder 20 on the left side and a right front shoulder 21 on the right side. In the left front shoulder 20, the right end moves along the neck hole 14, and the left end moves toward the left sleeve 8. Therefore, the left front shoulder 20 has the shape having the point D at the left upper end protruding toward the left sleeve 8 as shown in FIG. 1. The point D at the left upper end of the left front shoulder 20 and the point F at the left upper end of the back shoulder 22 appear at the same position in the left-right direction. The right front shoulder 21 is knitted in the same manner. The right end of the right front shoulder 21 is slanted from the lower point I' to the upper point H' corresponding to the shape of the neck hole 14. The point D' at the right upper end of the right front shoulder 21 protrude to the right beyond the point C'. The point D' at the right upper end of the right front shoulder 21 and the point F' at the right upper end of the back shoulder 22 appear at the same position in the left-right direction. Next, the other points in FIG. 1 will be described. I, I' are left and right end points at the lower end of the neck hole, H, H' are left and right end points at the upper end of the neck hole (H, H' are points of the front body), and K, K are points of the back shoulder 22 corresponding to H, H'.

Figure 2:
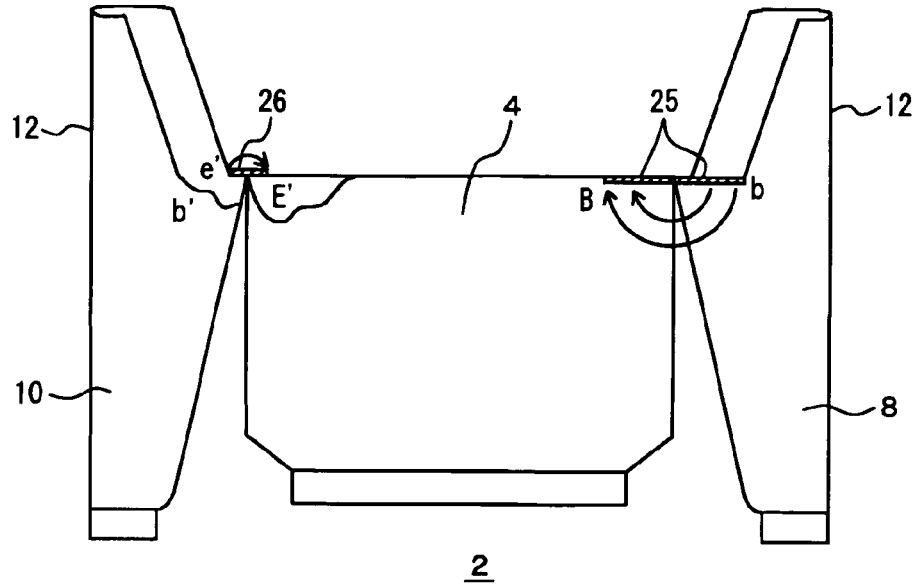
FIG. 2 is a view schematically showing a state in which the sweater with asymmetrically joined sleeves in FIG. 1 has been knitted up to underarm positions, and front-back asymmetrical gores have been knitted.

After the sleeve caps 12, 12 are knitted for both of the sleeves 8, 10, the left sleeve 8 is joined to the front body 4 and the back body 6 using a gore by joining the points (a, A), (b, B), and (e, E) together. Also in the right sleeve 10, a gore is formed such that the points (a', A'), (b', B'), and (e', E') are joined together. Gore forming portions 25, 25 on the side of the front body and the front sleeves are wider than gore forming portions 26, 26 on the side of the back body and the back sleeves. The gore forming portions 26 on the side of the back sleeves may not be provided. FIG. 2 schematically shows a state in which the gores have been formed (the knitting state 3A in FIG. 1).

Figure 3:
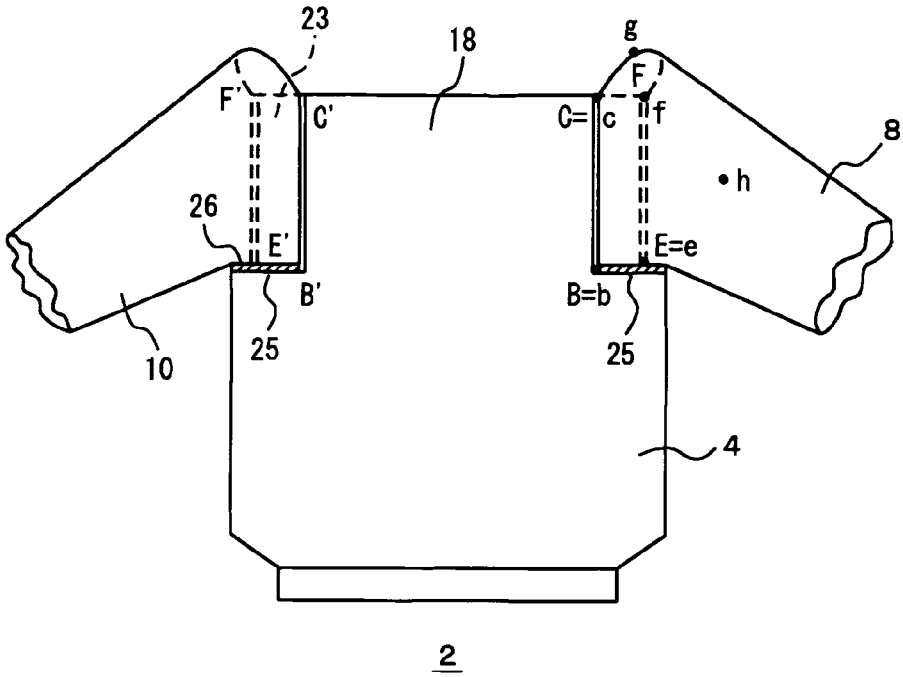
FIG. 3 is a view schematically showing a state in which the sweater has been knitted up to a line C–C' in FIG. 1, after the state in FIG. 2.

FIG. 3 shows a state in which knitting of the upper front body 18 has been finished (knitting state 5S in FIG. 1). The upper back body 23 has been knitted in the same manner as the upper front body 18. The height of the upper ends of the upper front body 18 and the upper back body 23 is substantially the same as the height of the lower end of the neck hole 14. The point b of the left sleeve 8 and the point B of the front body are joined by the gore. The left sleeve 8 is joined to the front body while knitting the upper front body 18 such that the point C and the point c are joined, and the line B–C and the line b–c are overlapped with each other almost vertically. Likewise, the right sleeve 10 is joined to the upper front body 18 such that the line B'–C' and the line b'–c' are overlapped with each other. Further, the left sleeve 8 is joined to the upper back body 23 such that the line E–F and the line e–f are overlapped with each other. Likewise, the right sleeve 10 is joined to the upper back body 23 such that the line E'–F' and the line e'–f' are overlapped with each other.

Figure 4:
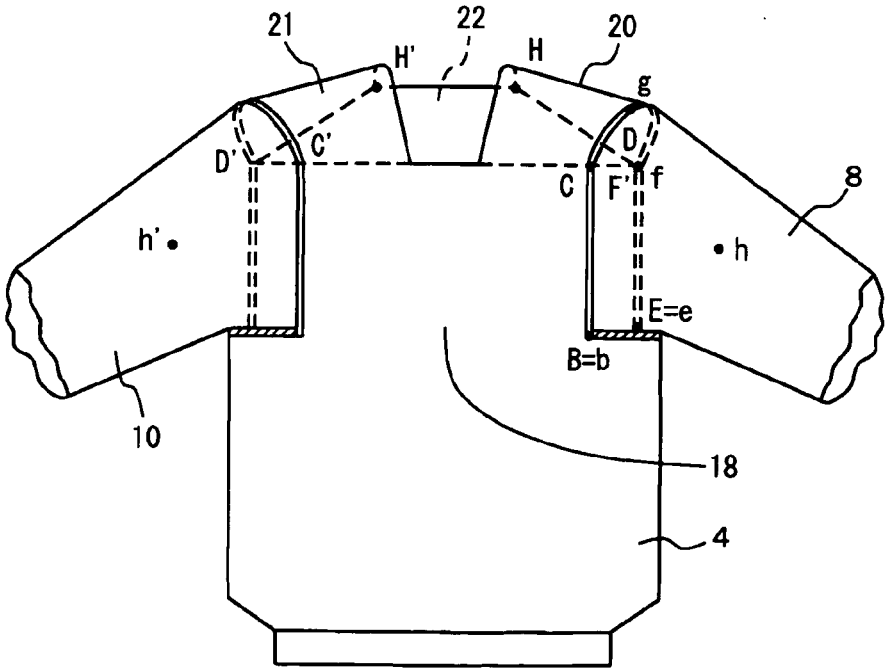
FIG. 4 is a view schematically showing a state of the sweater in which front shoulders and sleeves have been connected, and back shoulders have been knitted, before knitting the collar and after the state in FIG. 3.

Before knitting the back shoulder 22, the left front shoulder 20 and the right front shoulder 21 are knitted on both sides of the neck hole 14. At this time, the line C–D of the left front shoulder 20 is joined to the line c–f of the left sleeve 8. Likewise, the line C'–D' of the right front shoulder 21 is joined to the line c'–f' of the upper part of the right sleeve 10. In FIG. 1, the borders between the front side and the backside of the sleeves 8, 10 are denoted by h, h'. The sleeve caps 12 are narrow on the front sleeve side, and the gore forming portions 25 on the front side are wider than the gore forming portions 26 on the backside. Therefore, as shown in FIG. 4, h, h' appear on the front side of the sleeves. Stated otherwise, the sleeves are naturally oriented forward, and fit the human body when the sweater is worn. Thus, the sweater can be worn comfortably. By attaching the collar 16 from the state shown in FIG. 4, knitting of the sweater 2 is finished.

The sweater 2 is produced without sewing. However, for example, sewing may be used for attaching the collar or the pocket. In the context of the present invention, the feature of "without sewing" is particularly meaningful in the portions of forming the gores 25, 26, joining both sleeves 8, 10 to the front body 4 and the back body 6, and joining the upper end of the front body 4 and the upper end of the back body 6.

Figure 5:
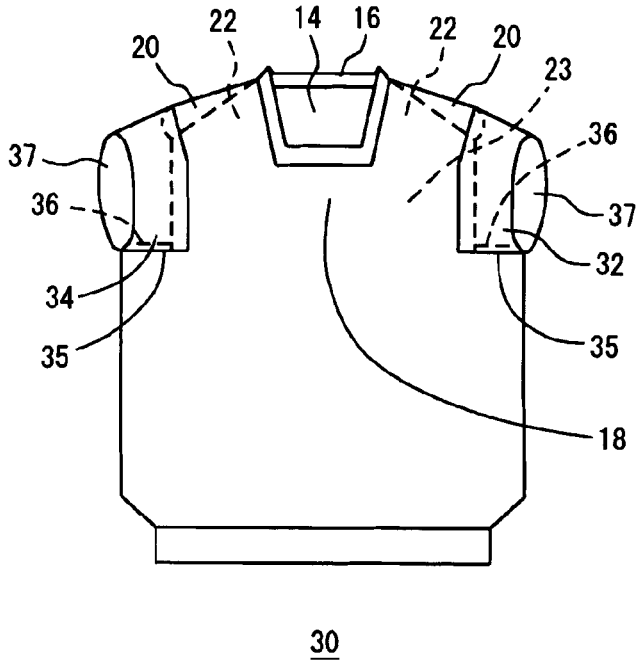
FIG. 5 is a view schematically showing a short-sleeved sweater knitted according to the embodiment.

As the garment with asymmetrically joined sleeves, a short-sleeved sweater 30 as shown in FIG. 5 may be knitted. Further, it is a matter of course that a vest may be knitted as the garment. In FIG. 5, a reference numeral 32 denotes a left sleeve, a reference numeral 34 denotes a right sleeve, reference numerals 35, 36 denote gores. The gores 35 on the front side are wider than the gores 36 on the backside. As a result, the knitting width of the upper front body 18 is narrower than the knitting width of the upper back body 23. The center of the armhole 37 is inclined forward, and the sleeves 32, 34 are oriented forward. The short-sleeved sweater 30 in FIG. 5 is considered to be the same as the sweater in FIG. 1 except that the distance between the underarm to the lower sleeve edge is reduced significantly.

Figure 6:
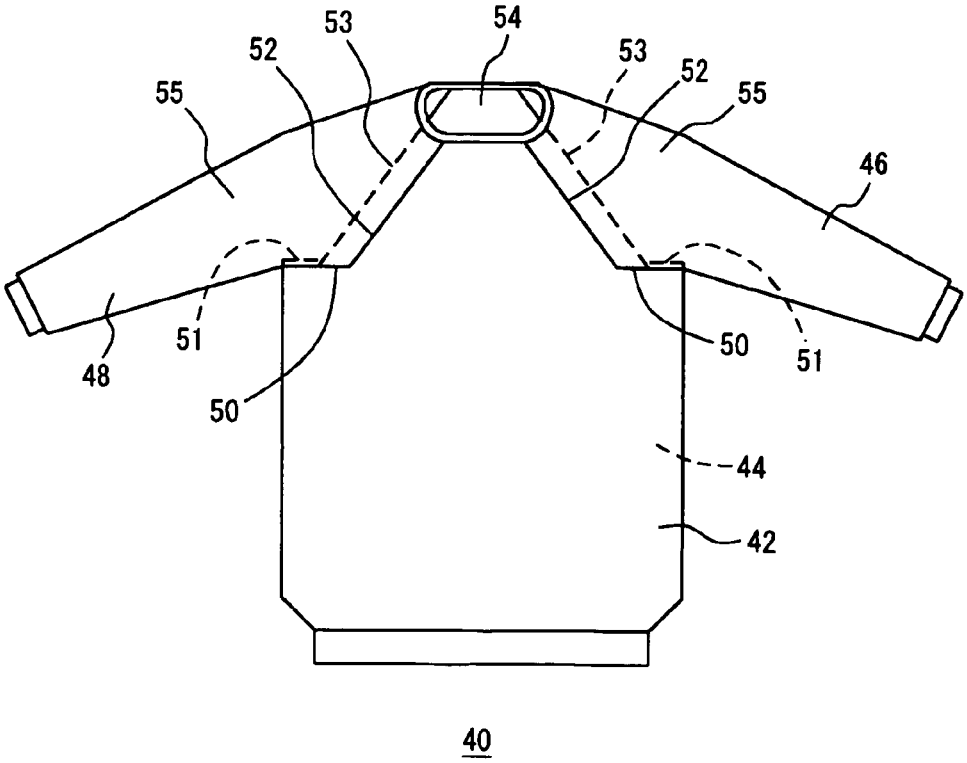
FIG. 6 is a view schematically showing a raglan sweater knitted in a modified embodiment.

FIG. 6 shows an example in which the embodiment is applied to a raglan sweater 40. A reference numeral 42 denotes a front body, a reference numeral 44 denotes a back body, a reference numeral 46 denotes a left sleeve, and a reference numeral 48 denotes a right sleeve. Gores 50, 50 on the front side are wider than gores 51, 51 on the backside. Joint lines 52 between the sleeves 46, 48 and the front body 52 are positioned inside joint lines 53 between the sleeves 46, 48 and the back body 44. A reference numeral 54 denotes a neck hole. Also in the case of the raglan sweater 40, sleeve caps 55, 55 are knitted by flechage knitting before knitting the gores 50, 51, and the gores 50, 51 are formed such that the gores 50 on the front side become wider than the gores 51 on the backside. Further, the sleeve caps 55 on the front side (front sleeve caps 55) are narrower than the sleeve caps 55 on the backside (back sleeve caps 55). Since the gores 50 are wider than the gores 5 1, the joint lines 52 are inside the joint lines 53. The joint lines 52, 53 are in parallel to each other, and narrowing stitches are formed in each predetermined course of the joint lines 52, 53. In the sleeve cap 55, since the sleeve cap on the front side is narrower than the sleeve cap on the backside, the sleeves face forward naturally, and the garment can be worn comfortably.

FIGS. 7 to 11 show the steps of knitting the sweater 2 in FIG. 1. The type of the sleeve setting is set-in. The numbers of the knitting steps, e.g., 1 to 6 are used independently in each of the drawings. The same number represents different steps in different drawings. The positions or the names of members of the sweater 2 will be referred using the reference numerals in FIG. 1. It is assumed that a flat knitting machine having four needle beds is used, for example. Also in the case where a flat knitting machine having two needle beds is used, the similar knitting can be carried out using the known broad rib knitting.

Both sleeves 8, 10 are knitted into cylindrical shapes up to the positions of the sleeve caps 12. In the same manner, the body is knitted into a cylindrical shape up to the underarm positions. In step 1 of FIG. 7, a state of engagement between the body and the sleeves on the needle floor when knitting has been carried out up to the underarm positions is shown. In step 2, for knitting the gores, both sleeves are drawn toward the body side such that the sleeves are positioned alongside the body. At this time, the front body and both front sleeves are fixed to a lower front bed FD, and the back body and both back sleeves are fixed to a lower back bed BD. In step 3, the stitches of the left front sleeve are transferred to the upper back bed BU, and the stitches of the right back sleeve are transferred to the upper front bed FU such that the gore between the right back sleeve and the back body is formed, and about the half of the gore between the left front sleeve and the front body is formed. After step 3, and before step 4, the right back sleeve is transferred back to the original lower back bed BD. In step 4, while racking the back bed to the left, the gore is formed. At this time, in order to prevent the yarn cut, the knit stitches at the end of the right back sleeve are sequentially rotated to the front bed.

Figure 8:
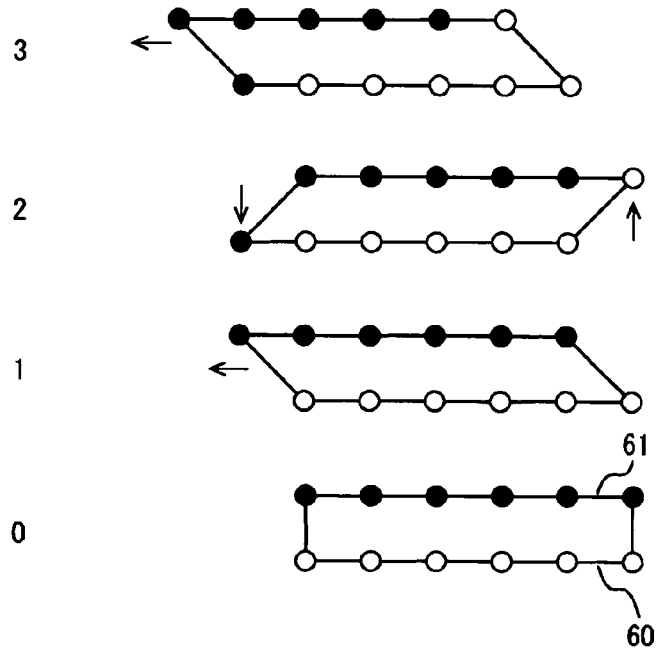
FIG. 8 is diagram showing rotation operation used in knitting in FIG. 7.

FIG. 8 shows the principle of rotation. In step 0, it is assumed that the knitted fabrics 60, 61 face each other. In step 1, for example, the knitted fabric 61 on the backside is shifted to the left by racking. In step 2, knit stitches at both ends are transferred. Then, in step 3, the knitted fabric is shifted again. Thereafter, transferring and racking are repeated. In this manner, it is possible to rotate the knitted fabrics on the flat knitting machine.

Figure 7:
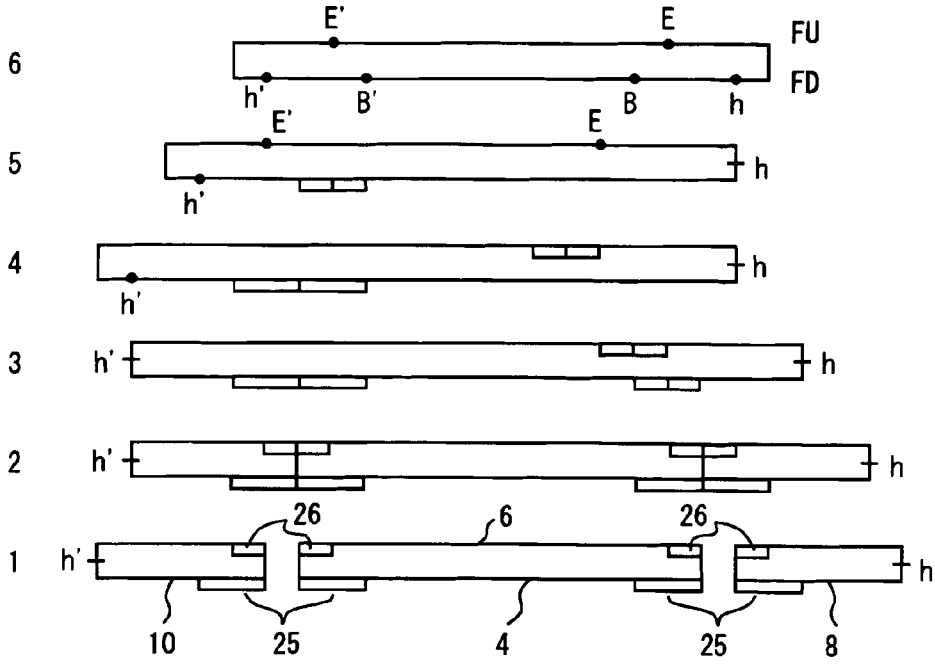
FIG. 7 is a view showing the overview of a knitting method for front-back asymmetrical gores in the embodiment.

In step 4 of FIG. 7, formation of the gore between the front body and the left front sleeve is finished. In step 5, the gore between the back body and the left back sleeve is formed, and about the half of the gore between the front body and the right front sleeve is formed. After step 5, and before step 6, the left back sleeve is rotated toward the lower front bed FD. Then, in step 6, the rest of the gore between the front body and the right front sleeve is formed. In this manner, the left and right back sleeves are rotated toward the front bed. The borders h, h' between the front and back sleeves are shifted toward the front bed.

Figure 9:
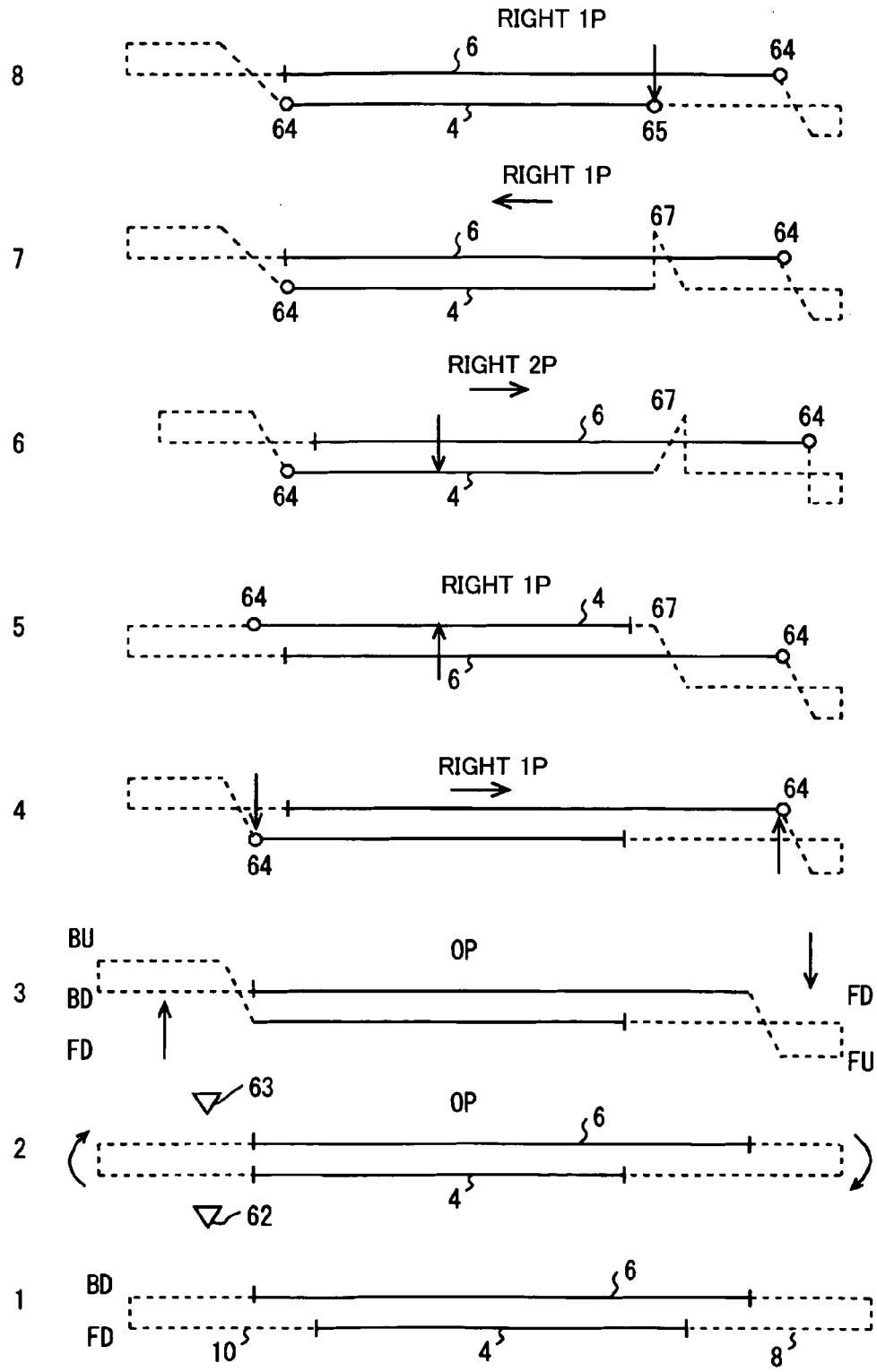
FIG. 9 is a diagram showing main steps of joining a front body and both sleeves from a line B–B' to the line C–C' in FIG. 1.
Figure 10:
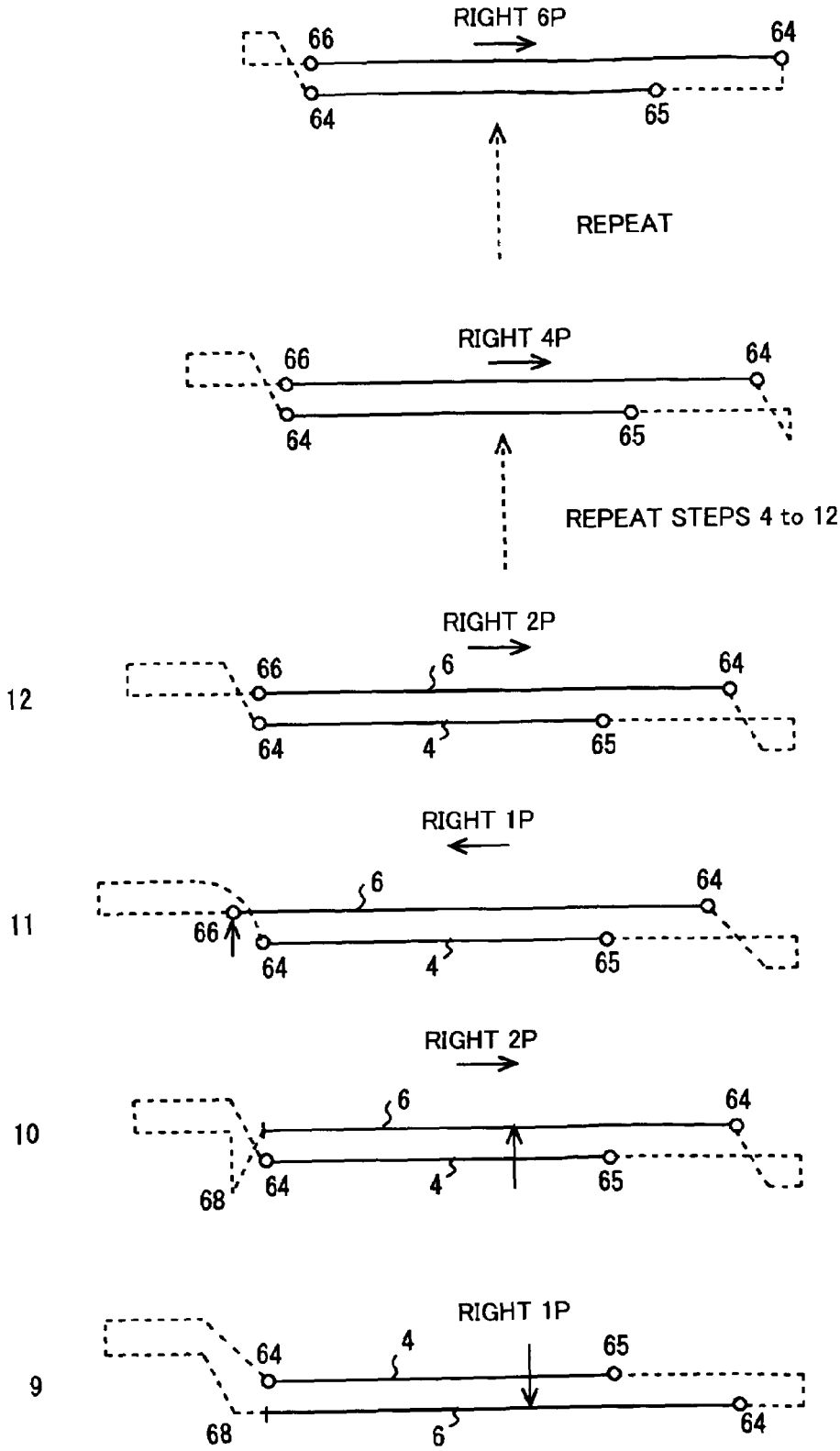
FIG. 10 is a diagram showing the joining steps after the steps in FIG. 9.

FIGS. 9 and 10 show steps of joining the upper front body 18 and the upper back body 23 to the sleeve caps 12, 12. Step 1 of FIG. 9 shows a state in which formation of the gores has been finished. From this state, in step 2, for example, the knitted fabrics are rotated clockwise. The right end of the front body 4 and the right end of the back body 6 are aligned to face each other on the needle bed. A yarn feed portion 62 is used for feeding a yarn for the front body 4. A yarn feed portion 63 is used for feeding a yarn for the back body 6.

These yarn feed portions 62, 63 are positioned outside the right ends of the bodies 4, 6, for the purpose of ensuring that the yarn feed portions 62, 63, especially, the yarn feed portion 62 for the front body 4 having the narrow knitting width does not enter the knitting width of the back body to hinder the knitting operation such as transferring or course knitting in steps 3 to 12. The yarn feed portion 63 may wait at a position outside the left end of the back body 6.

It is assumed that the knitted fabrics are initially positioned on the lower front bed FD and the lower back bed BD. From this position, transferring is carried out as shown in step 3. In step 4, by racking the upper and lower back beds BU, BD to the right by one pitch, and by transferring, one knit stitch at the end of one sleeve is joined to the right end of the front body, and one knit stitch at the end of the other sleeve is joined to the left end of the back body to form a pair of overlapping stitches 64, 64. One of the overlapping stitches 64, 64 is positioned at the end of the front body which has been aligned with the end of the back body, and the other of the overlapping stitches 64, 64 is positioned at the end of the back body on the opposite side. In step 5, the front body and the knit stitches 67 at the end of the sleeve are transferred to the upper back bed BU. In step 6, the knit stitches are transferred again to the original bed. The knit stitches 67 at the end of the sleeve are left on the upper back bed BU. In step 7, racking is carried out, and in step 8, transferring is carried out. Thus, the next overlapping stitch 65 can be obtained at the end of the front body 4 (the end of the front body 4 opposite to the end which is in alignment with the end of the back body).

In step 9, the back body and the knit stitches 68 of the end of the sleeve are transferred to the upper front bed FU. In step 10, after racking of the upper and lower back beds BU, BD is carried out by one pitch to the right, only transferring of the back body is carried out. In step 11, by transferring the knit stitches 68, an overlapping stitch 66 can be obtained at the end of the back body (end of the back body facing the end of the front body). In this manner, one stitch at each opposite end of the front body and at each opposite end of back body, in total, four overlapping stitches are formed. Then, in step 12 or the like, the front body and the back body are knitted by the suitable number of courses, e.g., two courses for each of the front body and the back body. By repeating steps 4 to 12, narrowing stitches are formed, and thus, joining of the sleeve and the body and knitting of the upper front body and the upper back body are carried out.

Figure 11:
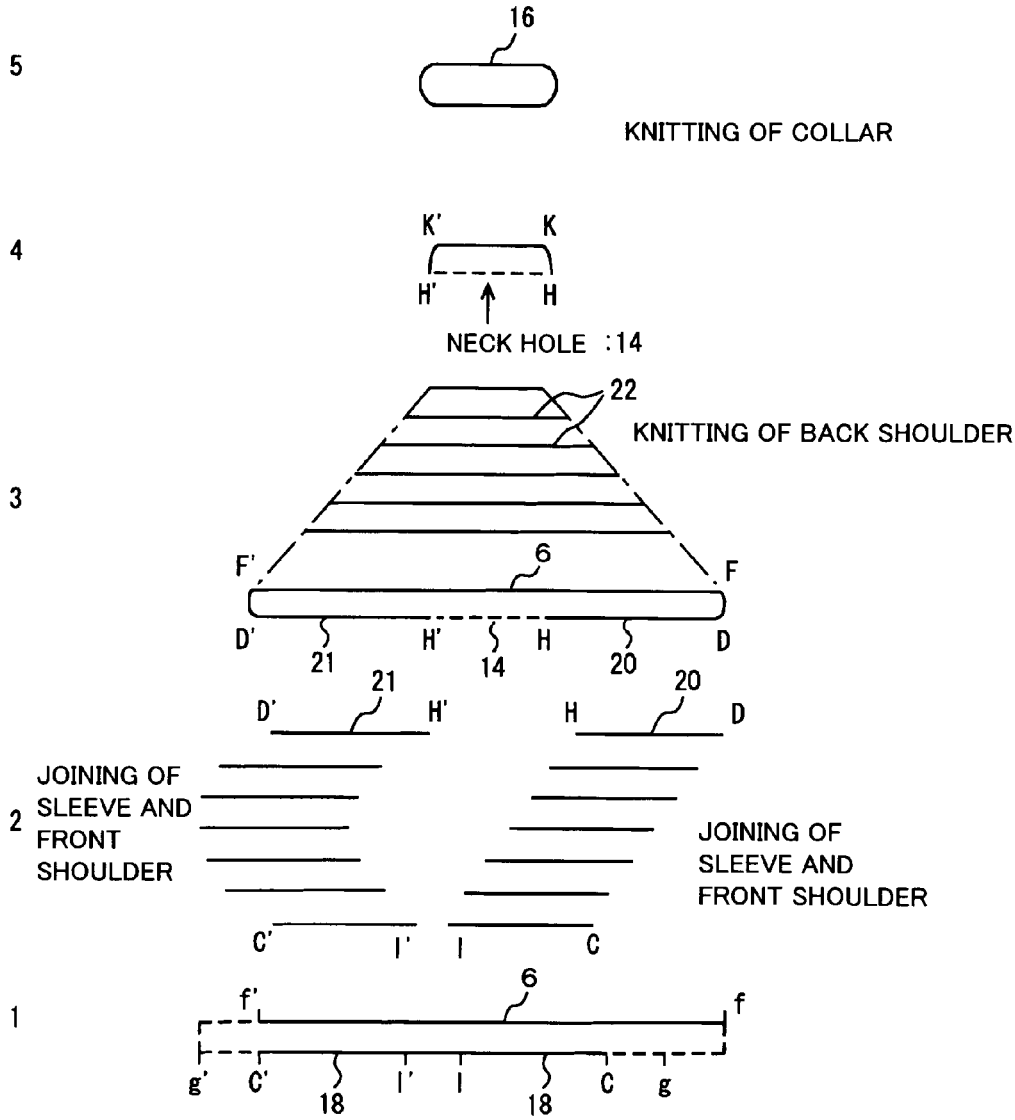
FIG. 11 is a view showing the overview of knitting operation from a state 5S (joining of both front shoulders and sleeves) in FIG. 1 to a state 7C (knitting of the collar).

FIG. 11 shows the steps of knitting from the portion of the neck hole 14. Step 1 schematically shows a state before knitting the portion of the neck hole 14. Step 2 schematically shows knitting of the left front shoulder 20 and the right front shoulder 21, and joining the left front shoulder 20 and the right front shoulder 21 to the sleeves. Knitting is carried out such that the knitted fabric gradually moves toward the sleeve side. For example, knitting is carried out while moving the knitted fabric for every predetermined number of courses, e.g., two courses. If necessary, widening stitches are formed on the left side of the left front shoulder 20 and on the right side of the right front shoulder 21 to increase the knitting width. In the meanwhile, the sleeves and the front shoulders are joined together. The knit stitches at the left and right ends of the front shoulders and the knit stitches at the ends of the sleeves are overlapped with, and joined together. Thus, the point c, the point g, and the point f of the sleeve cap are joined to the point C, the point G, and the point D of the left front shoulder 20, respectively. The point g is the middle point between the point f and the point c. The point G is the middle point between the point D and the point C. The border point h is positioned on the front side of the point g. The right front shoulder 21 is processed in the same manner.

In step 3, the back shoulder 22 is knitted. While gradually narrowing the knitting width, the knit stitches of the back shoulder 22 and the front shoulder 20, 21 are overlapped with, and joined together. Thus, the sweater 2 becomes a state in step 4. From this state, the collar 16 is knitted to complete the sweater 2.

Figure 12:
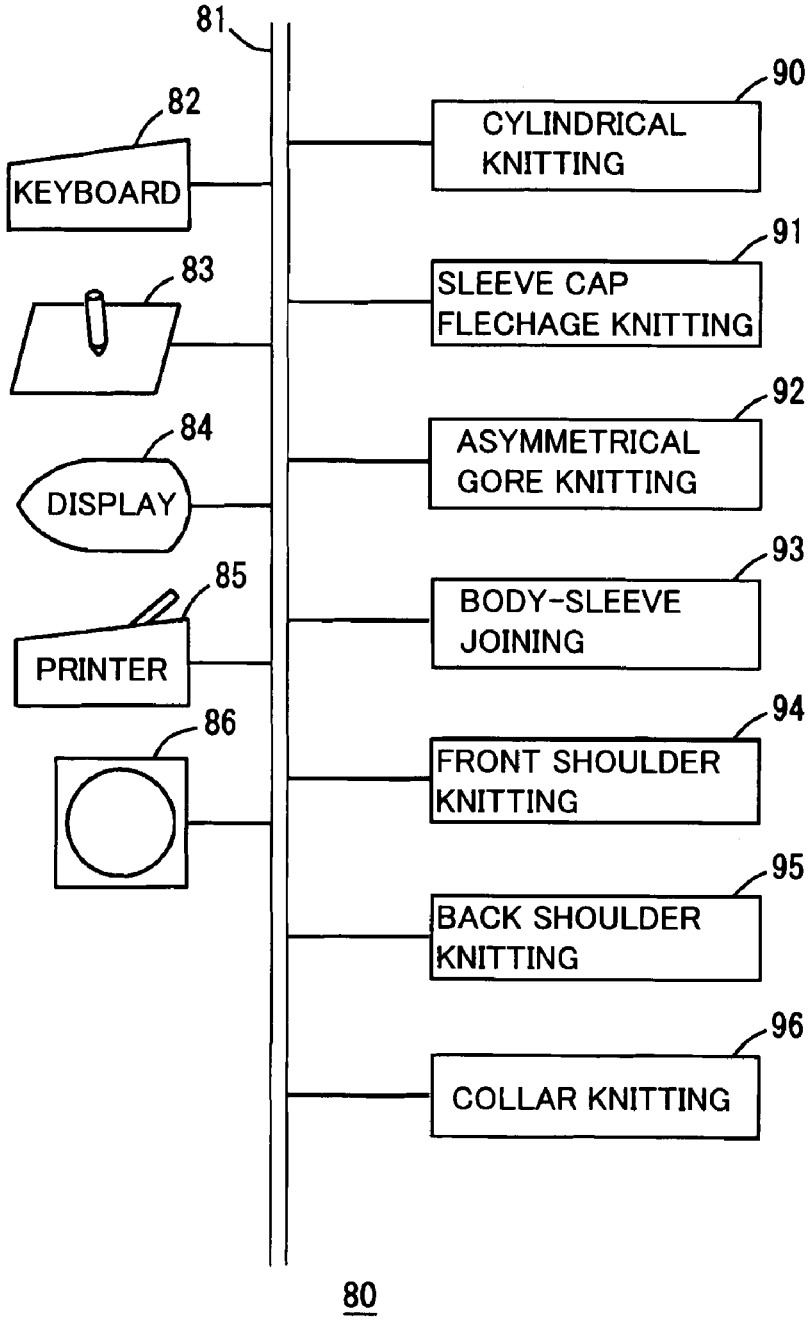
FIG. 12 is a block diagram showing a knit design device supporting knitting of the garment with asymmetrically joined sleeves in the embodiment.

FIG. 12 shows a knit design device 80 used in the embodiment. The knit design device 80 is intended to generate knitting data for the garment with asymmetrically joined sleeves which have been described in connection with the embodiment, in accordance with the design of the user. A reference numeral 81 denotes a bus, a reference numeral 82 denotes a keyboard, and a reference numeral 83 denotes a stylus. Additionally, input devices such as a mouse or a track ball may be provided. A reference numeral 84 denotes a display such as a color monitor, a reference numeral 85 denotes a color printer, and a reference numeral 86 denotes a disk. Further, the knit design device 80 may be connectable to a LAN.

A cylindrical knitting unit 90 generates knitting data needed for cylindrically knitting the body up to the underarm positions or both sleeves in accordance with the design of the user. The components as described later also generate knitting data for respective parts in accordance with the design of the user. A sleeve cap flechage knitting unit 91 generates knitting data for flechage knitting of the asymmetrical sleeve cap (the backside of the sleeve cap is wider than the front side of the sleeve cap). An asymmetrical gore knitting unit 92 generates knitting data of front and back gores. The front gore and the back gore are asymmetrical. The front gore is larger than the back gore. The back gore may not be provided. A body sleeve joining unit 93 generates data for joining the upper front body and the upper back body to both sleeves above the underarm positions, and knitting the upper front body and the upper back body. A front shoulder knitting unit 94 generates knitting data for knitting the front shoulder and joining the front shoulder to the sleeve. A back shoulder knitting unit 95 generates knitting data for knitting the back shoulder and joining the back shoulder and the front shoulder. Knitting of the back shoulder may be carried out mainly for joining and only a small number of knit stitches may be formed. Alternatively, a large number of knit stitches may be formed at the time of knitting the back shoulder. A collar knitting unit 96 generates knitting data for the collar.

In the embodiment, it is possible to knit the garment with asymmetrically joined front and back sleeves. The sleeves are oriented forward, and the garment fits the body shape. Further, when the garment is worn, wrinkles are few on the front side, and the stress is small on the backside. Thus, a beautiful silhouette can be obtained. In the embodiment, a sweater is used as an example. Alternatively, the present invention is also applicable to other garments such as a one-piece suit, a dress, or a vest.

In the embodiment, the sleeve cap is formed beforehand. The knit stitches in the final course of the sleeve cap are joined to the knitted stitches at the end of the front body. When the garment such as the sweater is worn, the knit stitches in the final course of the sleeve cap appear on the backside of the knit stitches at the end of the front body. Therefore, the twisted knit stitches by rotation of the sleeve cap from the backside to the front side are hidden. Further, in order to prevent the rotated knit stitches of the back sleeve from being twisted in the joint portion, the yarn is fed in the opposite direction for the knit stitches that are rotated at the time of knitting the sleeve cap in the final course, so that twisted knit stitches are formed beforehand. The twisted stitches should be eliminated by transferring at the time of rotation. For this purpose, assuming that the backside of the sleeve cap is rotated to the front side, e.g., in the final course, by three stitches, for knitting the three knit stitches at the end of the backside, the yarn should be fed in the direction opposite to the yam feeding direction for knitting the other knit stitches. For example, assuming that the yarn feeding direction of the other knit stitches is the direction from the left to the right, for the third knit stitch from the end, after the yarn feed portion passes through the position of the third knit stitch, the yarn is fed while returning the yam feed portion from the right to the left to form the third knit stitch. In the same manner, the second knit stitch from the end is formed by feeding the yarn from the right to the left in the direction opposite to the yarn feeding direction for knitting the other knit stitches. The knit stitch at the end is formed in the same manner, by feeding the yarn in the opposite direction.

BRIEF DESCRIPTION OF SYMBOLS

2 Sweater
4 Front body
6 Back body
8 Left sleeve
10 Right sleeve
12 Sleeve cap
14 Neck hole
16 Collar
18 Upper front body
20 Left front shoulder
21 Right front shoulder
22 Back shoulder
23 Upper back body
25, 26 Gore forming portion
30 Short-sleeved sweater
32 Left sleeve
34 Right sleeve
35, 36 Gore
37 Armhole
40 Raglan sweater
42 Front body
44 Back body
46 Left sleeve
48 Right sleeve
50, 51 Gore
52, 53 Joint line
54 Neck hole
55 Sleeve cap
60, 61 Knitted fabric
62, 63 Yarn feed portion
64–66 Overlapping stitch
67, 68 Knit stitch
80 Knit design device
81 Bus
82 Keyboard
83 Stylus
84 Display
85 Color printer
86 Disk
90 Cylindrical knitting unit
91 Sleeve cap flechage knitting unit
92 Asymmetrical gore knitting unit
93 Body sleeve joining unit
94 Front shoulder knitting unit
95 Back shoulder knitting unit
96 Collar knitting unit

The invention claimed is:

1. A method of knitting a garment with asymmetrically joined sleeves by knitting a body and both sleeves up to underarm positions to have cylindrical shapes, respectively, then, joining both sleeves to the body, and then, joining upper ends of a front body and a back body of the body, comprising the steps of:

(a) after knitting both sleeves to the underarm positions, knitting sleeve caps comprising front sleeve caps and back sleeve caps for both sleeves by flechage knitting such that the front sleeve caps become narrower than the back sleeve caps;

(b) then, forming gores t the underarm positions for connecting both front sleeves and the front body without forming any gores between both back sleeves and the back body, or in the case of forming gores between both back sleeves and the back body, forming gores at the underarm positions for connecting both front sleeves and the front body such that the gores between both back sleeves and the back body become smaller than the gores between both front sleeves and the front body; and (c) then, knitting the front body and the back body and joining the front body and the back body to both sleeves such that the knitting width of the front body becomes smaller than the knitting width of the back body above the underarm positions.

2. The knitting method of claim 1, further comprising the step of:

(d) after the step (c), knitting the front body separately into a left front body and a right front body at a neck hole portion, and expanding the left front body toward a left sleeve side, expanding the right front body toward a right sleeve side such that a left upper end of the left front body is substantially aligned with a left upper end of the back body in the left-right direction and a right upper end of the right front body is substantially aligned with a right upper end of the back body in the left-right direction.

3. The knitting method of claim 1, wherein the step (c) is carried out in a state in which one ends of the front body and the back body face each other on a needle bed, and the other ends of the front body and the back body do not face each other on the needle bed.

4. The knitting method of claim 3, wherein the step (c) comprises the steps of:

overlapping a knit stitch at the one end of the front body with an adjacent knit stitch of the sleeve, and overlapping a knit stitch at the other end of the back body with an adjacent knit stitch of the sleeve;

overlapping a knit stitch at the other end of the front body with an adjacent knit stitch of the sleeve, and overlapping a knit stitch at the one end of the back body with an adjacent knit stitch of the sleeve; and knitting a course of new knit stitches on the front body and the back body.

5. A garment with asymmetrically joined sleeves, the garment including a body comprising a cylindrical knitted fabric and both sleeves each comprising a cylindrical knitted fabric, wherein the body and both sleeves are joined on sides by knitting operation without sewing, and a front body and a back body of the body are joined at shoulders, and wherein (a) both sleeves include front and back sleeve caps above underarm positions, and the front sleeve caps are narrower than the back sleeve caps;

(b) front portions of both sleeves are joined to the front body at the underarm positions by gores such that the knitting width of the front body becomes smaller than the knitting width of the back body above the underarm positions; and (c) the front body and the back body are joined to both sleeves without sewing on sides.

6. A knit design device capable of generating knitting data for knitting a garment by knitting a body and both sleeves up to underarm positions to have cylindrical shapes, respectively, then, joining both the sleeves to the body, and then, joining upper ends of a front body and a back body of the body, the knit design device comprising:

(a) sleeve cap flechage knitting data generating means for generating knitting data of caps of the sleeves for knitting in a manner that after knitting both the sleeves up to the underarm positions, the caps of the sleeves comprising caps of the front sleeves and caps of back sleeves for both the sleeves are knitted by flechage knitting such that the caps of the front sleeves become narrower than the caps of the back sleeves;

(b) asymmetrical gore knitting data generating means for generating knitting data of gores for forming front gores at the underarm positions to connect both the front sleeves to the front body, wherein no back gore is formed between the back body and both the back sleeves, or back gores are formed between the back body and both the back sleeves such that the back gores become smaller than the front gores; and (c) body sleeve joining data generating means for generating knitting and joining data of the body and the sleeves, for knitting the front body and the back body and joining the front and back bodies to both the sleeves such that a knitting width of the front body becomes smaller than a knitting width of the back body above the underarm positions, in correspondence with width of the front gores if no back gores are formed, or in correspondence with a difference between width of the front gores and the back gores if the back gores are formed, wherein the pieces of knitting data are used by a flat knitting machine in the order of (a) to (c).

* * * * *